US010646838B2

(12) United States Patent
Yoo

(10) Patent No.: US 10,646,838 B2
(45) Date of Patent: May 12, 2020

(54) FINE BUBBLE WATER GENERATOR

(71) Applicant: NEWMANTECH CO., LTD., Incheon (KR)

(72) Inventor: Youngjune Yoo, Incheon (KR)

(73) Assignee: NEWMANTECH CO., LTD., Incheon (KR)

( * ) Notice: Subject to any disclaimer, the term of this patent is extended or adjusted under 35 U.S.C. 154(b) by 258 days.

(21) Appl. No.: 15/906,085

(22) Filed: Feb. 27, 2018

(65) Prior Publication Data

US 2019/0262787 A1 Aug. 29, 2019

(51) Int. Cl.

| | |
|---|---|
| ***B01F 7/00*** | (2006.01) |
| ***B01F 3/04*** | (2006.01) |
| *B01F 7/02* | (2006.01) |
| *B01F 7/04* | (2006.01) |

(52) U.S. Cl.

CPC ..... *B01F 7/009* (2013.01); *B01F 3/04609* (2013.01); *B01F 7/005* (2013.01); *B01F 7/0085* (2013.01); *B01F 7/00883* (2013.01); *B01F 7/025* (2013.01); *B01F 7/045* (2013.01)

(58) Field of Classification Search

CPC .... B01F 3/04609; B01F 7/005; B01F 3/0453; B01F 2003/04858; B01F 13/1027; B01F 7/008; B01F 7/00808; B01F 7/009; B01F 7/008833; B01F 7/0085; B01F 7/025; B01F 7/045

See application file for complete search history.

(56) References Cited

U.S. PATENT DOCUMENTS

| | | | | |
|---|---|---|---|---|
| 8,465,198 | B2 * | 6/2013 | Hassan | B01F 7/00766 366/155.1 |
| 8,889,002 | B2 * | 11/2014 | Mohr | B01F 3/04609 210/205 |
| 8,939,436 | B2 * | 1/2015 | Takase | B01F 3/04503 261/118 |
| 9,034,195 | B2 * | 5/2015 | Wood | A01K 63/042 210/750 |
| 10,065,167 | B2 * | 9/2018 | Kozyuk | B01F 7/00816 |
| 10,093,567 | B2 * | 10/2018 | Park | A01K 63/045 |
| 2013/0252323 | A1 * | 9/2013 | Wood | B01F 3/04531 435/289.1 |
| 2014/0332989 | A1 * | 11/2014 | Alenzi | B01F 7/00033 261/76 |
| 2019/0232238 | A1 * | 8/2019 | Goi | B01F 3/0446 |

* cited by examiner

*Primary Examiner* — Stephen Hobson

(57) ABSTRACT

Disclosed is a fine bubble water generator including: a housing being configured with an inflow line on one end thereof where air and fluid enters and a discharge line on an opposite end where fine bubble water is discharged; a partition allowing the air and fluid entered into the inflow line to flow in zigzags inside the housing; and a fine bubble water generation cylinder unit, being inserted into a space formed by the partition, allowing the air and fluid to be induced to collide with a surface thereof having bumps formed thereon and on an inner circumferential surface of the housing or the partition, thereby refining air bubbles and fluid by frictional force caused by a flat surface and the partition.

5 Claims, 5 Drawing Sheets

【FIG. 1】
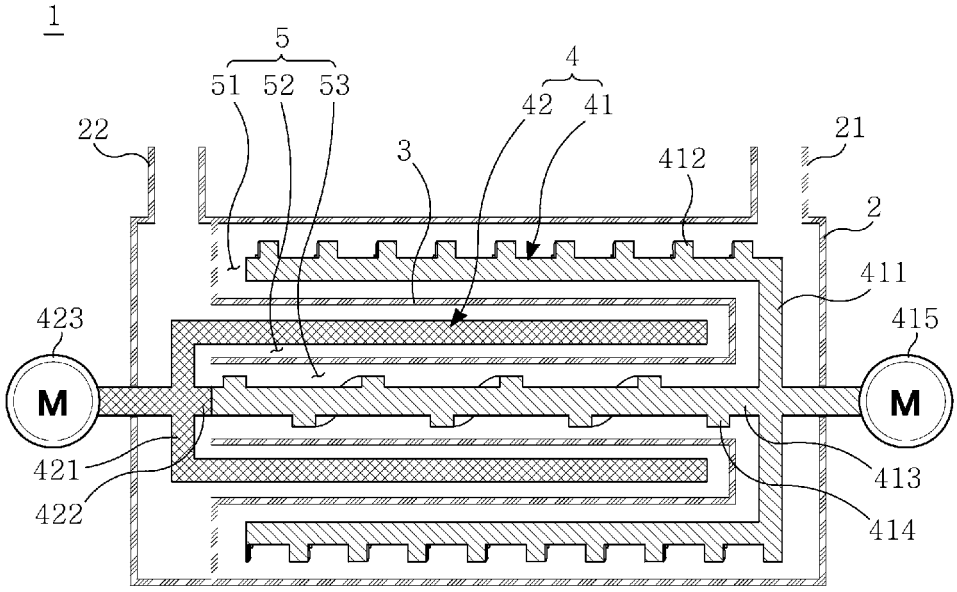

【FIG. 2】
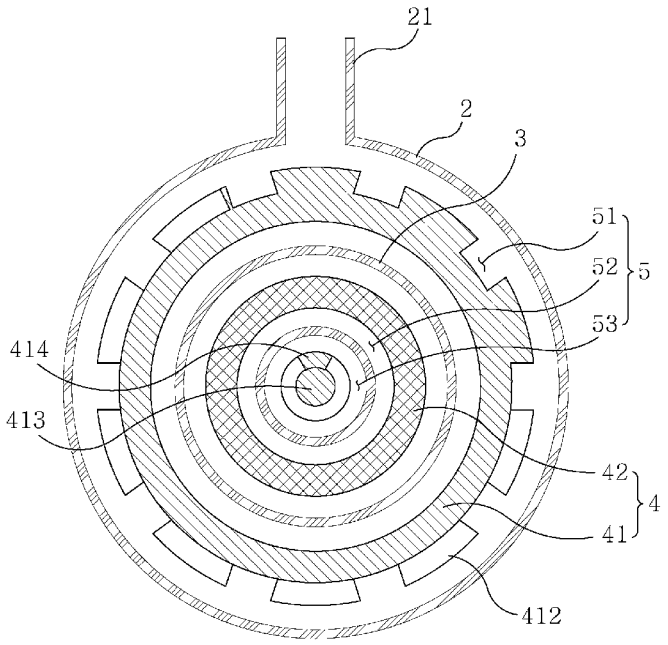

【FIG. 3】
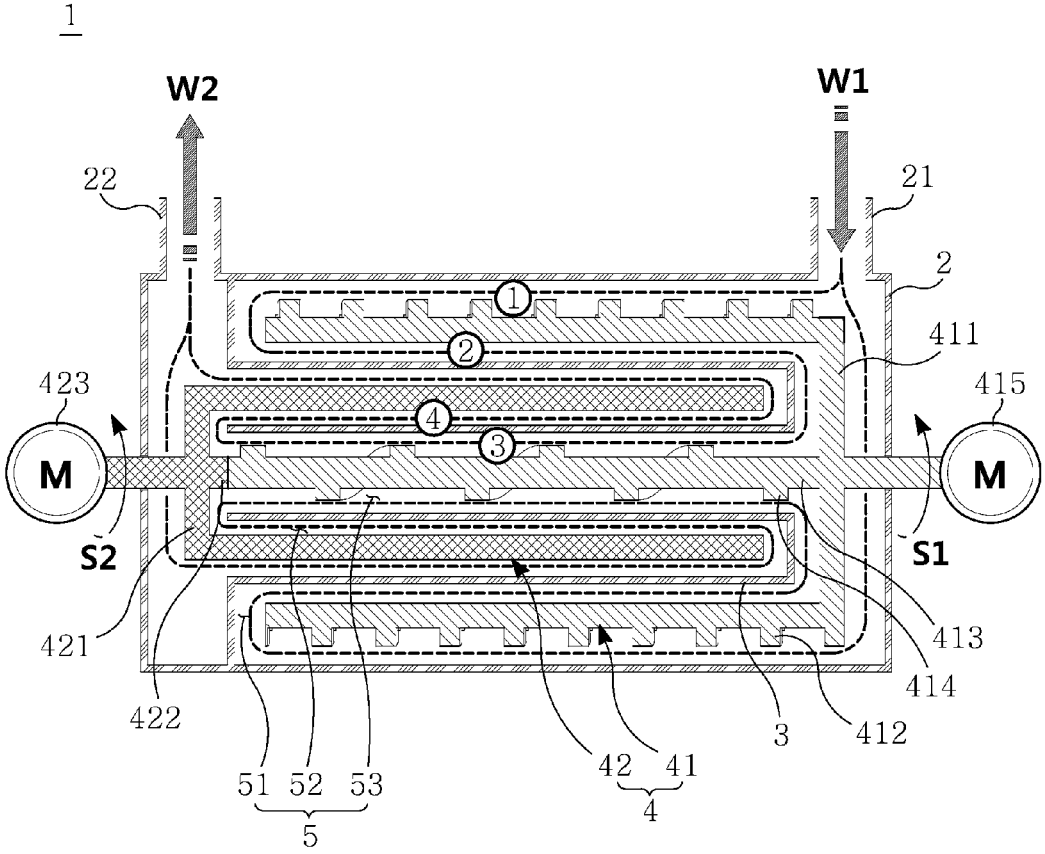

【FIG. 4】
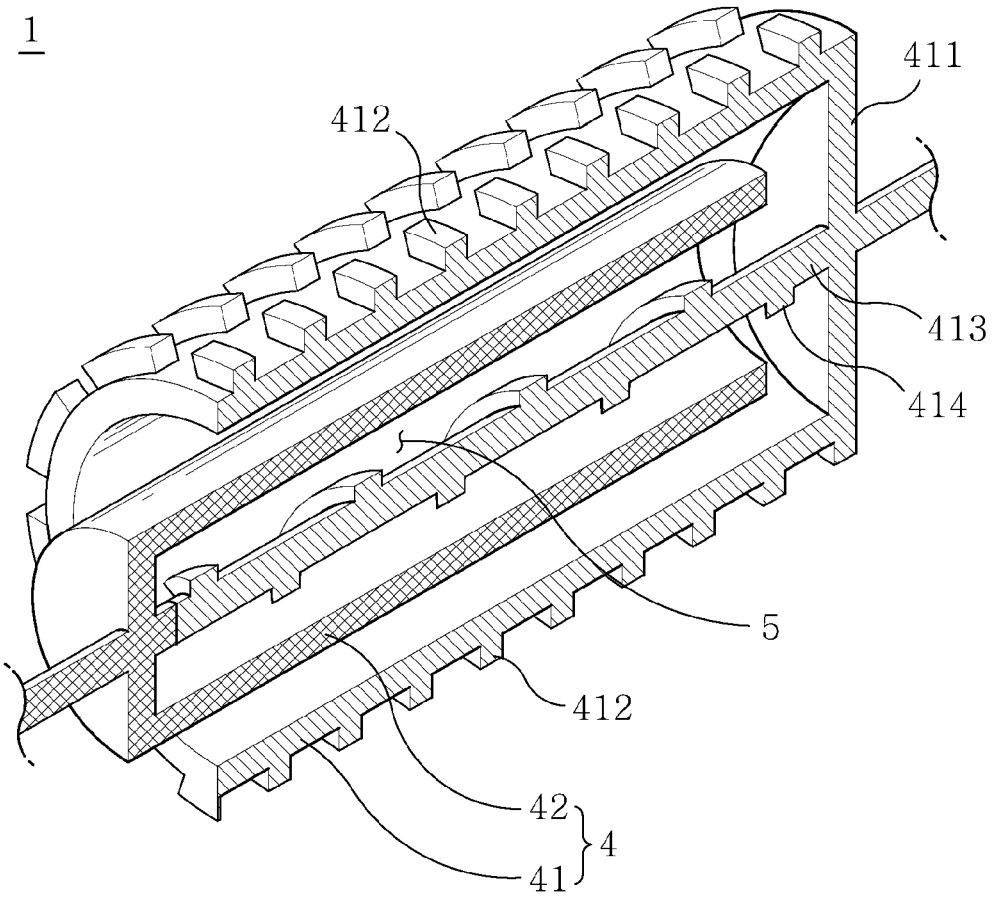

【FIG. 5】
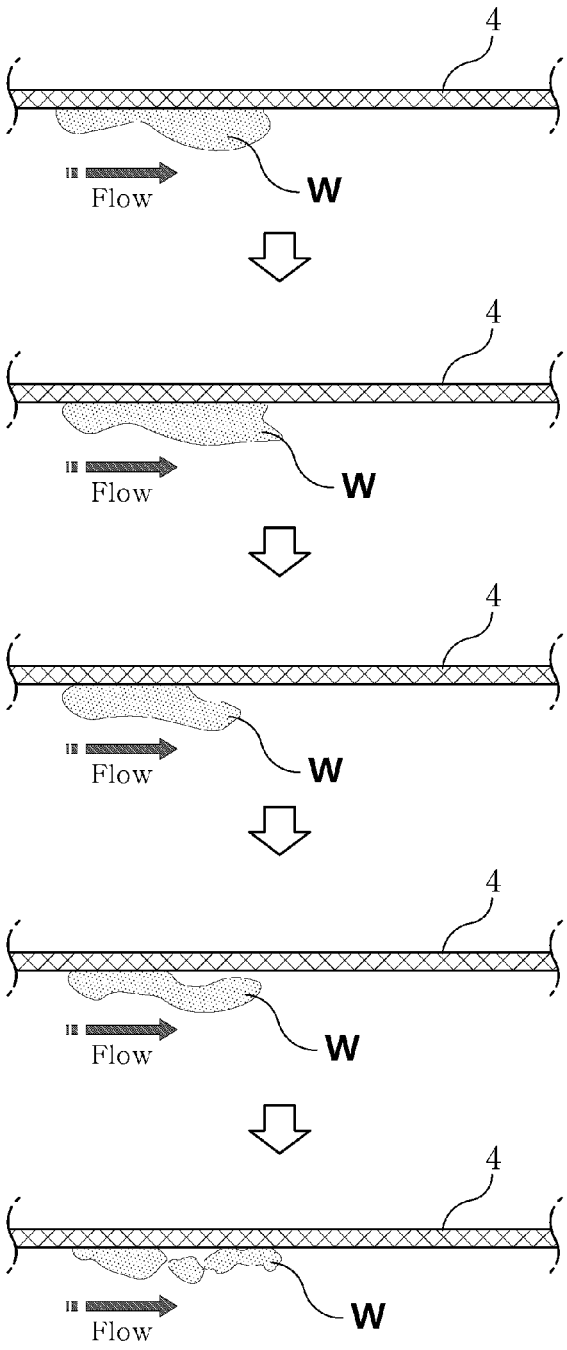

FINE BUBBLE WATER GENERATOR

BACKGROUND OF THE INVENTION

Field of the Invention

The present disclosure relates to a fine bubble water generator configured to enhance generation efficiency of fine bubble water by alternatingly imposing a collision force and a shear force on input fluid and air.

Description of the Related Art

In conventional methods of fine bubble generation, a pressurized bubble generation method producing fine bubbles by lowering the air pressure below atmospheric pressure after saturating air pressurized by a compressor into water, and a bubble release type bubble generation method producing bubbles by allowing air to be passed through a nozzle (air diffuser) having fine holes are widely used.

For example, Korean Patent No. KR 10-0902189 provides an "Ultra micro-bubble generating apparatus and sedimentation apparatus using same" including a cylindrical body having an inlet and an outlet on both sides; a vortex generator allowing fluid in which air bubbles are included to pass through the cylindrical body to be formed into vortices; a bubble generator allowing air bubbles included in the fluid having passed through the vortex generator to be formed into micro-bubbles, wherein the bubble generator includes a retainer bar coupled to the outlet being allowed to be removed or coupled again, while allowing a part of the outlet of the body to be open; a tie rod coupled with the retainer bar on one end thereof and disposed along with an axis direction of the body; and an air bubble crusher, coupled with an outer circumferential surface of the tie rod, crushing air bubbles passing through the body.

However, even in the case of such a technology as above, it is difficult to expect a sufficient underwater detention time for the case of the fine air bubbles produced by such an apparatus, because it is not easy to refine the air bubbles homogeneously with sizes equal to or less than micrometers, whereby the conventional art has a problem that mass transfer efficiency of air bubbles is low.

In addition, as the sufficient underwater detention time of the air bubbles is difficult to expect, there is a problem that excessive energy should be used to continuously supply air bubbles.

DOCUMENTS OF RELATED ART

Patent Document (Patent Document 1) Korean Patent No. KR 10-0902189

SUMMARY OF THE INVENTION

Accordingly, the present disclosure has been made keeping in mind the above problems occurring in the related art, and the present invention is intended to propose a fine bubble water generator that is advantageous in terms of energy, and doubles mass transfer efficiency by securing sufficient underwater detention time of the fine bubbles as well as by enlarging a response surface area of fine bubbles by allowing homogeneous fine bubble water to be produced.

As a means to resolve the problems described above, a fine bubble water generator of the present disclosure includes: a housing being provided with an inflow line on one end thereof where air and fluid enters and a discharge line on an opposite end where fine bubble water is discharged; a partition allowing the air and fluid entered into the inflow line to flow in zigzags inside the housing; and a fine bubble water generation cylinder unit being inserted into a space formed by the partition, allowing the air and fluid to be induced to collide with a surface thereof having bumps formed thereon, and on an inner circumferential surface of the housing or the partition, and refining air bubbles and fluid by frictional force caused by a flat surface and the partition.

For example, the space includes a first space communicating with the inflow line, a second space defined inward from the first space and communicating with the discharge line, and a third space defined inward from the second space and communicating with the inflow line and the discharge line.

For example, the fine bubble water generation cylinder unit includes: a first generation cylinder including a first tube part having a tubular shape that is inserted into the first space and has a plurality of bumps formed on an outer circumferential surface thereof, and a first central axle that is inserted into the third space inside the first tube part and has a spiral bump formed on an outer circumferential surface thereof; and a second generation cylinder including a second tube part having a tubular shape that is inserted into the second space, and a second central axle that is inserted into the third space to face the first central axle.

For example, the first central axle is connected to a first motor located outside the housing, whereby the first generation cylinder is enabled to be rotated by the first motor, and the second central axle is connected to a second motor located outside the housing, whereby the second generation cylinder is enabled to be rotated by the second motor.

For example, the second motor is configured to be rotated at a higher velocity than the first motor.

As has been described so far, the present disclosure has an advantage of enhancing generation efficiency of homogeneous fine bubble water by allowing a collision force and a shear force to be alternatingly imposed on input fluid mixed with air.

BRIEF DESCRIPTION OF THE DRAWINGS

The above and other objects, features and other advantages of the present invention will be more clearly understood from the following detailed description when taken in conjunction with the accompanying drawings, in which:

FIG. 1 is a sectional view illustrating the present disclosure;

FIG. 2 is a cross-sectional view illustrating the present disclosure;

FIG. 3 is a sectional view illustrating an operation of the present disclosure;

FIG. 4 is a side-cut perspective view illustrating a fine bubble water generation cylinder unit of the present disclosure; and FIG. 5 is a schematic view illustrating a process where a shear force is imposed on the fluid in the fine bubble water generation cylinder unit.

DETAILED DESCRIPTION OF THE INVENTION

Hereinafter, the configuration and operation of the present disclosure will be described more in detail with reference to accompanying drawings. Throughout the drawings, the same reference numerals will refer to the same or like parts. In describing the present disclosure, on the basis of a principle that an inventor is entitled to appropriately define a concept of each term in order to describe the present disclosure in the best way, terms and words used in present description and claims should be understood as having a meaning and concept in accordance with a technical idea of the present disclosure.

As shown in FIG. 1, a fine bubble water generator 1 of the present disclosure includes: a housing 2 being configured with an inflow line 21 on one end where air and fluid enters and a discharge line 22 on an opposite end where fine bubble water is discharged; a partition 3 allowing the air and fluid entered into the inflow line 21 to flow in zigzags inside the housing 2; a fine bubble water generation cylinder unit 4, being inserted into a space 5 formed by the partition 3, allowing the air and fluid to be induced to collide with a surface thereof where bumps 412 are formed and an inner circumferential surface of the housing 2 or the partition 3, thereby refining the air bubbles and fluid by frictional force caused by flat surface and the partition 3.

Hereinafter, the configuration of the present disclosure will be described.

As shown in FIG. 3, the housing 2, being configured with the inflow line 21 where the air and fluid enters at one end and the discharge line 22 where fine bubble water is discharged at an opposite end, corresponds to a composition that allows the fine bubble water W2 to be discharged by an operating mechanism inside the housing 2, wherein the operating mechanism will be described below. Even though not shown in a drawing, the air and fluid W1 may be allowed such that the fluid mixed with the air enters into the inflow line 21 or the air and the fluid enters separately via separated lines into the inflow line 21.

The partition 3 allows the air and fluid entered into the inflow line 21 to flow in zigzags by compartmentalizing the inside of the housing 2, and, as shown in FIGS. 1 and 2, the space is to be formed in the housing 2 by construction of the partition 3.

The space 5 where the fine bubble water generation cylinder unit 4 is inserted is to form a flow path along that the air and fluid flows, wherein the fine bubble water generation cylinder unit 4 will be described below. The space 5 is configured with a first space 51 connected to the inflow line 21, a second space 52 defined inward from the first space 51 and connected to the discharge line 22, and a third space 53 defined inward from the second space 52 and connected to the inflow line 21 and the discharge line 22. That is, the partition 3 allows the inside of the housing 2 to be compartmentalized into the first space 51, the second space 52, and the third space 53. As shown in the drawing, the partition 3 is connected at a part where the discharge line 22 starts to be formed. Meanwhile, the partition 3 allows the first space 51 to be formed by extending the tubular shape thereof toward the direction of the inflow line 21 so that separation from the inner circumferential surface of the housing 2 is formed. In addition, the partition 3 is bent down around the inflow line 21 and connected up to a part where the discharge line 22 starts to be formed, whereby the second space 52 and the third space 53 are formed along the both sides thereof.

The fine bubble water generation cylinder unit 4 is configured with two parts: a first generation cylinder 41 and a second generation cylinder 42.

First, the first generation cylinder 41 includes a first tube part 411 of the tubular shape that is inserted into the first space 51 and has a plurality of bumps 412 famed on an outer circumferential surface thereof, and the first central axle 413 that is inserted into the third space 53 inside the first tube part 411 and has a spiral bump 414 formed on an outer circumferential surface thereof. In addition, the first central axle 413 is connected to a first motor 415 located outside the housing 2, whereby the first generation cylinder 41 is enabled to rotate interlockingly. Accordingly, the first tube part 411 is to be interlockingly rotated in the first space 51, and the first central axle 413 is to be interlockingly rotated in the third space 53.

Refining of the air bubbles and fluid is accomplished in such a way that a plurality of bumps 412 formed on an outer circumferential surface of the first tube part 411 collides with the air bubbles and fluid by the rotation interlock. In addition, refining of the air bubbles and fluid is accomplished in such a way that the spiral bump 414 formed on an outer circumferential surface of the first central axle 413 collides with the air bubbles and fluid by the rotation interlock.

The second generation cylinder 42 includes a second tube part 421 of the tubular shape that is inserted into the second space 52, and the second central axle 422 that is inserted into the third space 53 to face the first central axle 413. In addition, the second generation cylinder 42 is also connected to a second motor 423 located outside the housing 2, whereby the second generation cylinder 42 is allowed to be interlockingly rotated. Accordingly, the second tube part 421 is to be in the rotation interlock in the second space 52.

The second tube part 421 is composed of the inner and outer circumferential surfaces which are flat surfaces, and the air bubbles and fluid flowing between the inner and outer circumferential surfaces and the partition 3 is refined by the shear force due to friction as shown in FIG. 5. In addition, the frictional force is maximized as the second tube part 421 is actuated in the interlocking rotation, whereby a refining efficiency of the air bubbles and fluid is to be doubled.

As described above, as the first tube part 411 is inserted into the first space 51, the first central axle 413 is inserted into the third space 53, and a second tube part 421 is inserted into the second space 52, the air and fluid entered through the inflow line 21 becomes to flow in zigzags inside the housing 2. Accordingly, fine bubble water is allowed to be formed by the operating mechanism mentioned above.

More preferably, by allowing the second motor 423 to be rotated in interlocking rotation at a higher velocity than the first motor 415, whereby a rotation velocity of the second generation cylinder 42 becomes higher than a rotation velocity of the first generation cylinder 41, finally, increasingly maximizing the refining efficiency of the fine bubble water discharged into the discharge line 22 is proper. That is, sequential refining is allowed to be accomplished.

Hereinafter, operation of the present disclosure having the configuration as described above will be described with reference to FIG. 3.

First, the air and fluid W1 entered through the inflow line 21 becomes to flow ① the flow path formed by the inner circumferential surface of the housing 2 and the outer circumferential surface of the first generation cylinder 41. In this process, the pressure varies due to a plurality of bumps 412 on the outer circumferential surface of the first tube part 411, whereby the refining is accomplished, and the refining is accomplished by imposing a collision force on the air bubbles and fluid through rotation of bumps 412 following the rotation of the first tube part 411.

The air bubbles and fluid primarily refined like this becomes to flow ② the flow path formed by the inner circumferential surface of the first tube part 411 and the partition 3. In this process, the shear force is imposed on the air bubbles and fluid, whereby the refining is accomplished. In addition, as mentioned above, the refining efficiency becomes larger as the frictional force becomes larger by the interlocking rotation of the first tube part 411.

The air bubbles and fluid secondarily refined in the process to flow ② mentioned above becomes to flow ③ the flow path formed by the first central axle 413 and the partition 3. In this process too, the pressure varies due to the spiral bump 414 on the first central axle 413, whereby the refining is accomplished, and the refining is accomplished by imposing the collision force on the air bubbles and fluid through rotation of the bump 414 following the rotation of the first central axle 413.

The air bubbles and fluid thirdly refined in the process to flow ③ mentioned above becomes to flow ④ the flow path formed by the inner and outer circumferential surfaces of the second tube part 421 and the partition 3. In this process too, the shear force is imposed on the air bubbles and fluid, whereby the refining is accomplished. In addition, as mentioned above, the refining efficiency becomes larger as the frictional force becomes larger by the interlocking rotation of the second tube part 421. Furthermore, as mentioned above, by allowing the second generation cylinder 42 to have a higher rotation velocity than the first generation cylinder 41, the refining efficiency of the fine bubble water discharged into the discharge line 22 is finally further maximized.

Like this, the present disclosure not only enlarges a response surface area by the refining of the bubble by inducing the refining of the fluid and air bubbles by allowing the collision force and the shear force to be alternately imposed on the air bubbles and fluid, but also doubles the mass transfer efficiency, and allows the fine bubble water to be produced, which is advantageous even in energy aspect, by securing sufficient underwater detention time of the fine bubble following the refining of the fluid.

Through the contents described above, those skilled in the art will clearly appreciate that various self-evident modifications, additions and substitutions are possible, without departing from the category of the present invention. Accordingly, the technical scope of the present disclosure should not be interpreted as being limited to the contents described in the specification, but be defined by the attached claims.

What is claimed is:

1. A fine bubble water generator, comprising:

a housing being provided with an inflow line on one end thereof where air and fluid enters and a discharge line on an opposite end where fine bubble water is discharged;

a partition allowing the air and fluid entered into the inflow line to flow in zigzags inside the housing; and a fine bubble water generation cylinder unit being inserted into a space formed by the partition, allowing the air and fluid to be induce to collide with a surface thereof having bumps formed thereon, and on an inner circumferential surface of the housing or the partition, and refining air bubbles and fluid by frictional force caused by a flat surface and the partition.

2. The fine bubble water generator of claim 1, wherein the space comprises a first space communicating with the inflow line, a second space defined inward from the first space and communicating with the discharge line, and a third space defined inward from the second space and communicating with the inflow line and the discharge line.

3. The fine bubble water generator of claim 2, wherein the fine bubble water generation cylinder unit includes:

a first generation cylinder including a first tube part having a tubular shape that is inserted into the first space and has a plurality of bumps formed on an outer circumferential surface thereof, and a first central axle that is inserted into the third space inside the first tube part and has a spiral bump formed on an outer circumferential surface thereof; and a second generation cylinder including a second tube part having a tubular shape that is inserted into the second space, and a second central axle that is inserted into the third space to face the first central axle.

4. The fine bubble water generator of claim 3, wherein the first central axle is connected to a first motor located outside the housing, whereby the first generation cylinder is enabled to be rotated by the first motor, and the second central axle is connected to a second motor located outside the housing, whereby the second generation cylinder is enabled to be rotated by the second motor.

5. The fine bubble water generator of claim 4, wherein the second motor is configured to be rotated at a higher velocity than the first motor.

* * * * *